United States Patent [19]

Bex

[11] 4,358,711

[45] Nov. 9, 1982

[54] CIRCUIT ARRANGEMENT FOR STARTING AND OPERATING A GAS- AND/OR VAPOR DISCHARGE LAMP

[75] Inventor: Hans Bex, Aachen, Fed. Rep. of Germany

[73] Assignee: U.S. Philips Corporation, New York, N.Y.

[21] Appl. No.: 146,551

[22] Filed: May 5, 1980

[30] Foreign Application Priority Data

Jun. 15, 1979 [DE] Fed. Rep. of Germany ..... 2924069

[51] Int. Cl.[3] ..... H05B 41/36

[52] U.S. Cl. ..... 315/208; 315/104; 315/309; 315/DIG. 7

[58] Field of Search ..... 315/99, 101, 103, 106, 315/224, 289, 309, 311, DIG. 7, 102, 104, 208, 360

[56] References Cited

U.S. PATENT DOCUMENTS 4,253,043 2/1981 Chermin et al. ..... 315/106

*Primary Examiner*—Eugene R. La Roche

*Attorney, Agent, or Firm*—Robert T. Mayer; Bernard Franzblau

[57] ABSTRACT

A circuit arrangement for starting and operating a discharge lamp by means of an electronic ballast includes a series arrangement of a PTC resistor and an ohmic resistor connected in parallel with an electronic switch of the ballast, with only the PTC resistor being in parallel with a control circuit of the electronic switch. The value of the ohmic resistor is 8 to 12 times the cold resistance of the PTC resistor.

9 Claims, 1 Drawing Figure

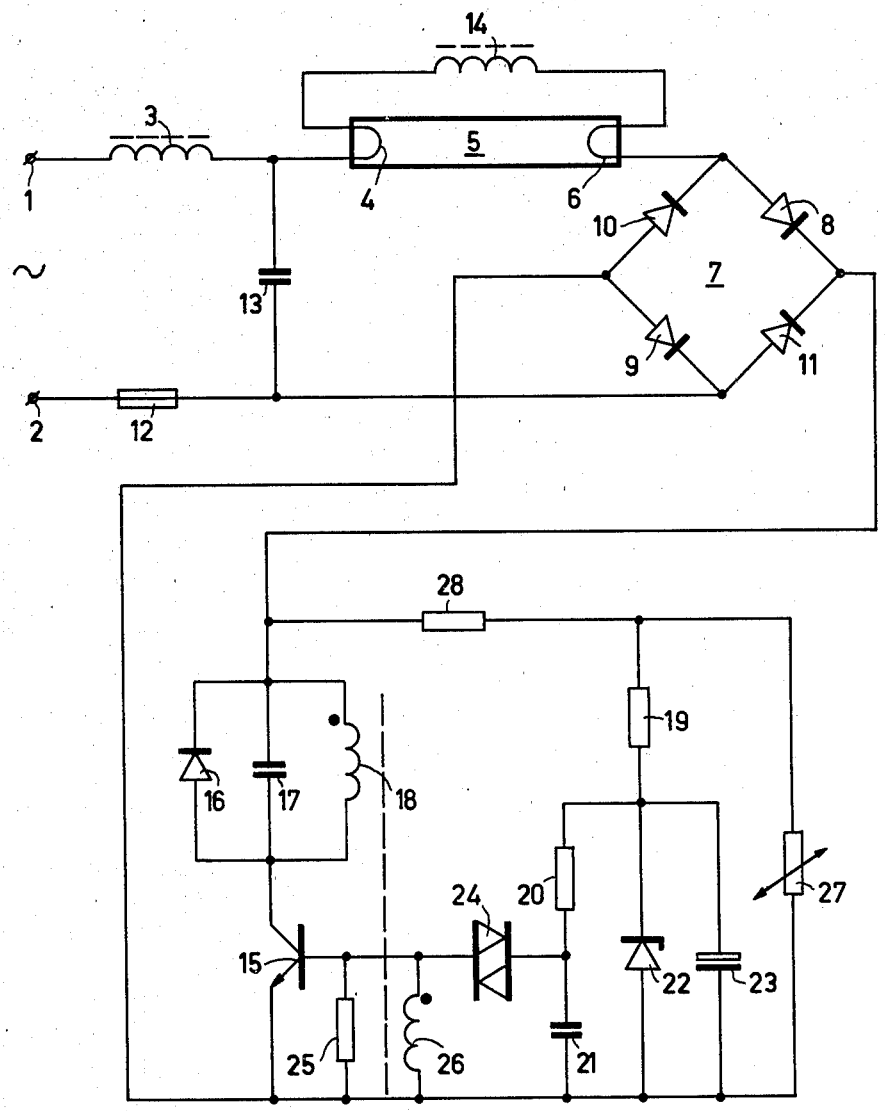
14
3
5
1
4
6
10
8
7
13
9
11
2
12
28
19
16
17
18
24
20
27
15
22
23
25
26
21

CIRCUIT ARRANGEMENT FOR STARTING AND OPERATING A GAS- AND/OR VAPOR DISCHARGE LAMP

The invention relates to a circuit arrangement for starting and operating a gas and/or vapour discharge lamp having preheatable electrodes whose free ends are—at least during starting of the lamp—electrically interconnected, and wherein an electronic switch is connected in series with the lamp to function as an electric ballast for limiting the current flow. The electronic switch is provided with a control circuit.

In such circuit arrangements the discharge lamp is energized at a frequency between approximately 400 Hz and 30 kHz, depending on the number of switching operations of the electronic switch. In a circuit arrangement of this type disclosed in U.S. Pat. No. 3,906,302 the electronic switch is already in operation during the ignitition procedure of the lamp, namely during the preheating of the lamp electrodes. This preheating operation can be of a relatively long duration, depending on the chosen duty factor of the electronic switch. Furthermore the preheating current is only limited by the resistance of the electrodes itself. This causes the preheating current to become rather high for a short period of time. This results in a relatively rapid destruction of the lamp electrodes in the known circuit arrangement. In addition, the discharge lamp ignites at an undeterminate instant, including times when the electrodes have not yet been preheated to a sufficient degree. This situation also has a negative effect on the life of the lamp.

An object of the invention is to provide a circuit arrangement of the type indicated in the preamble, whereby the abovementioned disadvantages are eliminated.

A circuit arrangement, according to the invention, for starting and operating a gas and/or vapour discharge lamp having preheatable electrodes whose free ends are—at least during starting of the lamp—electrically interconnected, includes an electronic switch connected in series with the lamp an electric ballast limiting current flow. The electronic switch is provided with a control circuit and the invention is characterized in that the electronic switch is shunted by a series connection of a resistor having a positive temperature coefficient (PTC) in series with an ohmic resistor, the value of the ohmic resistor being 8 to 12 times the cold resistance of the PTC resistor, and that only the PTC resistor is in parallel with the control circuit of the electronic switch.

Owing to the voltage division of the ohmic resistance and the cold resistance of the PTC resistor, the control circuit of the electronic switch does not receive, during preheating of the lamp electrodes, a voltage which is high enough to activate that switch. The lamp electrodes are therefore heated with a 50 Hz current. The heating current is limited by the ohmic resistance. After some time, approximately ½ to one sec., the voltage at the input of the control circuit is high enough so that the electronic switch starts operating, for example, at a frequency of approximately 16 kHz. The discharge lamp ignites practically simultaneously and free of flickering.

So the circuit arrangement according to the invention preheats the lamp electrodes with a 50 Hz current, after which the switch starts operating at a much higher frequency. This has a very advantageous effect on the operating life of the lamp.

If no ohmic resistance was used in series with the PTC resistor, and the cold resistance of this PTC resistor was adjusted in accordance with the desired lamp heating current, then the electronic switch would already be in operation during preheating of the lamp electrodes. This would result in the same drawbacks as those described above.

An embodiment of the invention will now be described with reference to the accompanying drawing.

The single FIGURE shows a circuit arrangement for starting and operating a discharge lamp.

Reference numerals 1 and 2 denote input terminals for connection to a 220 V, 50 Hz a.c. voltage supply. The terminal 1 is connected to a preheatable electrode 4 of a low-pressure mercury vapour discharge lamp 5 via a coil 3. A second preheatable electrode 6 of the lamp is connected to a bridge rectifier 7 comprising four diodes 8, 9, 10 and 11. The other side of the bridge rectifier 7 is connected to the input terminal 2 via a fuse 12. A capacitor 13 shunts the series connection of the lamp 5 and the bridge rectifier 7. Coil 3 and capacitor 13 form a low-pass filter. The free ends of the preheatable electrodes 4 and 6 are inter-connected across a choke 14. This choke may be replaced by a switch which is only in operation during preheating of the lamp electrodes.

The output terminals of the rectifier bridge 7 are coupled to a switching transistor 15 in series with a parallel combination which is customary for power switching transistors (cf. TI manual "Transistor Circuit Design", 1963, page 421). This parallel combination consists of a diode 16, a capacitor 17 and a coil 18. The control circuit of the transistor 15 has an input circuit which is formed by a series arrangement of a resistor 19, a resistor 20 and a capacitor 21, which series arrangement shunts the series connection of the transistor 15 and the parallel combination 16 to 18. A Zener diode 22 and a smoothing capacitor 23 are connected in parallel with the series arrangement of the resistor 20 and the capacitor 21. The base of transistor 15 is connected to the junction point of resistor 20 and capacitor 21 via a diac 24. In addition, the base of the transistor 15 is connected to the emitter of transistor 15 via a resistor 25 and a coil 26 arranged in parallel with the resistor. The coils 18 and 26 are coupled to one another.

A resistor 27 having a positive temperature coefficient (PTC) is arranged in series with an ohmic resistor 28 which limits the lamp heating current and whose resistance is 8 to 12 times the cold resistance of the PTC resistor 27. The series circuit composed of PTC resistor 27 and ohmic resistor 28 is connected in parallel with the electronic switch consisting of the transisor 15 and the parallel combination 16 to 18. Only the PTC resistor 27 is in parallel with the control circuit 19 to 26 of the transistor 5.

The above-described circuit operates as follows:

Depending on the polarity of the a.c. voltage applied to the input terminals 1 and 2, the electrodes 4 and 6 of the discharge lamp 5 are preheated via the circuit 1, 3, 4, 14, 6, 8, 28, 27, 9, 12, 2 or 2, 12, 11, 28, 27, 10, 6, 14, 4, 3, 1. As a result the heating current for the two electrodes 4 and 6 is limited by the ohmic resistor 28. Then, after hardly 1 sec., the PTC resistor 27 suddenly changes from its low to its high resistance value. At the instant the resistance of the PTC resistor 27 changes, the capacitor 21 is charged via the resistor 20, the resistor 19, and the ohmic resistor 28 to such a high voltage that the diac 24 is rendered conductive as a result of which the capacitor 321 can discharge via the parallel arrangement of the resistor 25, the coil 26 and the base-emitter resistor of transistor 15. This renders the transistor 15 conductive and a current flows through the circuit 1, 3, 4, 14, 6, 8, 17 and 18, 15, 9, 12, 2 or 2, 12, 11, 17 abd 18, 15, 10, 6, 14, 4, 3, 1.

The parallel combination 16 to 18 as well as the two intercoupled coils 18 and 26 have the sole purpose of improving the switching behaviour of transistor 15 so to reduce its power dissipation. Shortly after capacitor 21 has discharged, the diac 24 is rendered non-conductive again, which also causes the transistor 15 to become non-conducting. This switching operation results in such a high ignition voltage at the choke 14 that the discharge lamp 5 can ignite. Should the lamp not ignite, the procedure is repeated several times.

The time constant $C_{21}.R_{20}$ is chosen so that the pulse repetition frequency required for opening and closing the desired transistor 15 is obtained. The duty cycle of the pulse repetition is adjusted so that, by means of the resistor 25, the base-emitter resistor of transistor 15 and the coupling of the coils 18 and 26, the required lamp power is obtained.

In conjunction with the coil 3 the capacitor 13 provides a low-pass filter to prevent the high-frequency current pulses from being passed as interference into the public mains. On the other hand the 50 Hz AC supply may pass freely into the circuit arrangement.

In an embodiment for starting and operating a 20 W low-pressure mercury vapour discharge lamp, the components had practically the following values:

| | | |
|---|---|---|
| PTC-resistor 27 | Cold resistance | 45 Ohm |
| | Hot resistance | 16 kOhm |
| ohmic resistor 28 | | 500 Ohm |
| resistor 19 | | 15 kOhm |
| resistor 20 | | 3.3 kOhm |
| resistor 25 | | 56 Ohm |
| capacitor 21 | | 22 nF |
| capacitor 23 | | 4.7 μF |
| capacitor 17 | | 22 nF |
| capacitor 13 | | 0.47 μF |
| coil 3 | | 9.5 mH |
| choke 14 | | 2.3 mH |
| coil 18 | | 60 μH |
| coil 26 | | 200 μH |

The pulse repetition frequency was approximately 16 kHz. The average duty cycle was 1:7. The overall efficiency of the circuit was 92%.

Adaptation to a discharge lamp of a different power rating can be easily effected by changing the pulse repetition frequency or the duty cycle.

What is claimed is:

1. A circuit arrangement for starting and operating an electric discharge lamp including preheatable electrodes having free ends that are—at least during starting of the lamp—electrically interconnected, means connecting the lamp in series-connection with an electric ballast

2. Apparatus for energizing an electric discharge lamp having preheatable electrodes comprising, a pair of input terminals for connection to a source of supply voltage, an electronic controlled switch having a control electrode, means connecting said lamp in series with said electronic switch across said input terminals so that the electronic switch operates as an electric ballast to limit the lamp current, a control circuit coupled to the control electrode of the electronic switch for controlling the switch operation, a positive temperature coefficient (PTC) resistor, a first resistor having a resistance value greater than the cold resistance value of the PTC resistor, means connecting the first resistor and the PTC resistor in a series circuit, and means connecting said series circuit in shunt with the electronic switch and with the PTC resistor only in parallel with the control circuit whereby the electronic switch is maintained in a cut-off condition by the PTC resistor prior to ignition of the lamp.

3. Apparatus as claimed in claim 2 wherein the control circuit is connected to a junction point between the first resistor and the PTC resistor.

4. Apparatus as claimed in claims 2 or 3 further comprising an inductor and a capacitor coupled to said input terminals so as to form a low-pass filter for said apparatus.

5. Apparatus as claimed in claims 2 or 3 further comprising an inductor, a capacitor and a diode all connected in parallel with one another and in series with the lamp and the electronic switch and with the diode poled opposite to the electronic switch.

6. Apparatus as claimed in claims 2 or 3 wherein the resistance of the first resistor is 8 to 12 times the cold resistance of the PTC resistor.

7. Apparatus as claimed in claims 2 or 3 further comprising an inductor connected in parallel with the lamp.

8. Apparatus as claimed in claim 2 wherein the control circuit includes a capacitor that draws a charge current separate from the current flow in the PTC resistor.

9. Apparatus for energizing an electric discharge lamp having preheatable electrodes comprising, a pair of input terminals for connection to a source of AC supply voltage, an electronic controlled switch having a control electrode, means connecting said lamp in series with said electronic switch across said input terminals so that the electronic switch operates as an electric ballast to limit the lamp current, a control circuit coupled to the control electrode of the electronic switch for triggering the switch into operation at a frequency substantially higher than the supply voltage frequency, means coupled to the preheatable electrodes for providing a current path from the input terminals through the electrodes during the lamp pre-ignition period, and means coupled to the control circuit and to the input terminals for limiting the control circuit voltage during the lamp pre-ignition period to a value below the trigger voltage of the electronic switch thereby to hold the electronic switch in a cut-off condition for a time period sufficient to heat the preheatable electrodes to operating temperature.

* * * * *

UNITED STATES PATENT AND TRADEMARK OFFICE

CERTIFICATE OF CORRECTION

PATENT NO. : 4,358,711
DATED : November 9, 1982
INVENTOR(S) : HANS BEX

It is certified that error appears in the above—identified patent and that said Letters Patent is hereby corrected as shown below:

In Claim 1, line 6, after ballast insert the following:

-- which comprises an electronic switch for current limitation, a control circuit coupled to the electronic switch, and wherein the electronic switch is shunted by a series connection of a resistor having a positive temperature coefficient (PTC) in series with an ohmic resistor and connected so that only the PTC resistor is in parallel with the control circuit of the electronic switch, the value of the ohmic resistor being 8 to 12 times the cold resistance of the PTC resistor, whereby the electronic switch is maintained in a cut-off condition during preheating of the lamp electrodes prior to lamp ignition.--

Signed and Sealed this

*Sixth* Day of *September 1983*

[SEAL]

*Attest:*

GERALD J. MOSSINGHOFF

*Attesting Officer*

*Commissioner of Patents and Trademarks*